US009085854B2

(12) United States Patent
Lepomäki et al.

(10) Patent No.: US 9,085,854 B2
(45) Date of Patent: Jul. 21, 2015

(54) PRINTING PAPER PRODUCT, AS WELL AS A METHOD AND A SYSTEM FOR MANUFACTURING A PRINTING PAPER PRODUCT

(75) Inventors: Hannu Lepomäki, Tampere (FI); Esko Kukkamäki, Kangasala (FI); Mika Laitila, Hämeenlinna (FI); Mikko Vuori, Jämsä (FI)

(73) Assignee: UPM-KYMMENE CORPORATION, Helsinki (FI)

( * ) Notice: Subject to any disclaimer, the term of this patent is extended or adjusted under 35 U.S.C. 154(b) by 0 days.

(21) Appl. No.: 14/128,759

(22) PCT Filed: May 29, 2012

(86) PCT No.: PCT/FI2012/050523

§ 371 (c)(1),
(2), (4) Date: Dec. 23, 2013

(87) PCT Pub. No.: WO2012/175788

PCT Pub. Date: Dec. 27, 2012

(65) Prior Publication Data

US 2014/0124156 A1 May 8, 2014

(30) Foreign Application Priority Data

Jun. 21, 2011 (FI) ..... 20115637

(51) Int. Cl.

| | |
|---|---|
| ***D21H 17/67*** | (2006.01) |
| ***D21H 17/70*** | (2006.01) |
| ***D21H 25/14*** | (2006.01) |
| ***D21H 11/08*** | (2006.01) |
| ***D21H 17/68*** | (2006.01) |

(52) U.S. Cl.

CPC ..... *D21H 17/675* (2013.01); *D21H 11/08* (2013.01); *D21H 17/67* (2013.01); *D21H 17/68* (2013.01); *D21H 17/70* (2013.01); *D21H 25/14* (2013.01)

(58) Field of Classification Search

USPC ..... 162/181.2, 181.1, 9, 298

See application file for complete search history.

(56) References Cited

U.S. PATENT DOCUMENTS

| | | | | |
|---|---|---|---|---|
| 2001/0045265 | A1 | 11/2001 | Holik | |
| 2004/0200593 | A1 * | 10/2004 | Koskinen et al. | 162/205 |
| 2006/0060318 | A1 * | 3/2006 | Silenius et al. | 162/181.2 |
| 2006/0196624 | A1 * | 9/2006 | Brogdon et al. | 162/179 |
| 2008/0264586 | A1 * | 10/2008 | Likitalo et al. | 162/9 |

FOREIGN PATENT DOCUMENTS

| | | | |
|---|---|---|---|
| FI | 100729 | B | 2/1998 |
| FI | 117872 | B | 3/2007 |
| FI | 117873 | B | 3/2007 |
| WO | WO 97/01670 | A1 | 1/1997 |
| WO | WO 02/086238 | A1 | 10/2002 |
| WO | WO 02/090652 | A1 | 11/2002 |
| WO | WO 2005/121447 | A1 | 12/2005 |
| WO | WO 2010/015726 | A1 | 2/2010 |

OTHER PUBLICATIONS

Subramanian, "Engineering Fine Paper by Utilising the Structural Elements of the Raw Materials," *TKK Reports in Department of Forest Products Technology, Series A1*, 2008, Espoo.

International Search Report issued in International Patent Application No. PCT/FI2012/050523 dated Nov. 5, 2012.

Finnish Office Action issued in Finish Patent Application No. FI 20115637 dated Mar. 26, 2012.

* cited by examiner

*Primary Examiner* — Mark Halpern
(74) *Attorney, Agent, or Firm* — Oliff PLC

(57) ABSTRACT

The invention relates to a method for manufacturing a printing paper product, in which method natural fibres are introduced into a system which includes a paper machine. In the method, calcium hydroxide and carbon dioxide are admixed to natural fibres, for precipitating calcium carbonate onto the surfaces of the natural fibres, and said printing machine is used for manufacturing a printing paper product which includes at least said natural fibres, with calcium carbonate precipitated on their surfaces, as a filler for said printing paper product. The invention also relates to a system for manufacturing a printing paper product. Further, the invention relates to a calendered printing paper product which has not been coated with a pigment.

20 Claims, 6 Drawing Sheets

PRINTING PAPER PRODUCT, AS WELL AS A METHOD AND A SYSTEM FOR MANUFACTURING A PRINTING PAPER PRODUCT

This application is a 371 of PCT/FI2012/050523 filed 29 May 2012.

FIELD OF THE INVENTION

The invention relates to a method and a system for manufacturing a printing paper product. The invention also relates to a printing paper product.

BACKGROUND OF THE INVENTION

The printing paper product is paper intended to be printed by printing machines and manufactured, for example, for magazines and newspapers. The printing paper product may be coated, such as LWC paper, or uncoated, such as SC paper or newsprint. The main raw material for a printing paper product is usually natural fibre, for example mechanically pulped natural fibre, chemically pulped natural fibre, and/or recycled fibre. In prior art, there are several established printing paper grades with their own established requirements for the properties of the paper. Such printing paper grades include, among others, the above-mentioned SC (super calendered) paper, LWC (light weight coated) paper and newsprint.

BRIEF SUMMARY OF THE INVENTION

In the present invention, we disclose a novel solution for manufacturing a printing paper product, as well as a novel printing paper product. The printing paper product according to the invention comprises continuously precipitated calcium carbonate (CPCC), whose addition is integrated in the papermaking process.

The method according to the invention for manufacturing a printing paper product is primarily characterized in what will be presented in claim 5. The system according to the invention for manufacturing a printing paper product is primarily characterized in what will be presented in claim 14. The printing paper product according to the invention is primarily characterized in what will be presented in claims 1 and 20.

An advantageous embodiment of this invention relates particularly to wood containing, that is mechanically pulped natural fibre containing uncoated printing paper products. In wood-containing uncoated printing paper products, a balance between the cost factors and the requirements on the functional properties set for the final product has been established over the course of years. Such established properties set for the final product, which must have certain values according to the requirements, include, for example, paper density before calendering, paper density after calendering, fluffiness and rigidity of the paper, strength properties of the paper, such as for example tensile strength, tear strength, surface resistance, and z-strength, as well as properties relating to printing, such as printed gloss, gloss contrast, print evenness, and absorption property of the paper. Factors affecting the cost, in turn, include for example the raw materials as well as their processing, and the technical solutions of the production technology and the operation parameters of the production process.

The correlation between the above listed properties set as requirements for the final product and the cost technical solutions has been an obstacle in the prior art to finding significant new sources of cost efficiency. Typically, for example adding a filler to the printing paper product reduces the total production costs but simultaneously results in a significant impairment in strength properties and thereby also an impairment in runnability. The strength properties impaired by the addition of the filler can be improved, for example, by increasing the content of chemical pulp and/or by adding chemicals, but this will result in a significant increase in the production costs, which typically renders the initial filler addition unprofitable.

In the manufacture of uncoated printing paper products, it is necessary to apply significant calendering to achieve the printability properties required of the final product. This deteriorates the optical properties and, when the paper bulk diminishes, also the stiffness of the paper. In spite of the above mentioned facts, heavy calendering is still necessary when manufacturing methods of prior art are applied.

Of the wood-containing printing paper products, the present invention relates most advantageously to supercalendered paper, that is, SC paper. SC paper is uncoated calendered magazine paper. In SC paper, the filler content in the final product is nowadays already relatively high, typically about 25 to 33 wt-%, depending on the grammage of the final product. Because SC paper is uncoated printing paper, its manufacturing process involves heavy calendering, to obtain sufficient smoothness and thereby suitable printing surface properties required of printing paper. The high filler content of the SC paper, in combination with heavy calendering, typically results in a high density (typically a density >1100 $kg/m^3$) and a low bulk of the paper, for which reason the paper also has low rigidity.

Attempts to develop an uncoated printing paper product having a low density and/or a high filler content have been made in a number of ventures by various actors for more than 20 years. In these ventures, the increased filler content has been found to result in a deterioration in the paper strength properties and thereby an increase in the susceptibility to breaking, as well as an increase in the fluffiness of the paper, particularly during printing of the paper. Moreover, it has not been possible to avoid heavy calendering in the manufacture of an uncoated printing paper product, to maintain sufficient printing properties.

In an embodiment of this invention, for manufacturing a printing paper product, filler is included in a mechanically and/or chemically pulped fibre suspension by adding milk of lime and carbon dioxide, for precipitating calcium carbonate on the surfaces of natural fibres. According to an advantageous example, calcium carbonate is precipitated on the surfaces of fibre particles by first admixing carbon dioxide to the fibre fraction and then adding lime of milk. According to another example, carbon dioxide is precipitated on the surfaces of fibre particles by first admixing lime of milk to the fibre fraction and then precipitating the lime of milk with carbon dioxide to form calcium carbonate on the surfaces of the fibre particles.

According to an advantageous example, mechanically pulped natural fibre or so-called mechanical pulp is divided into at least two fibre fractions before precipitating calcium carbonate in connection with at least one of said fibre fractions. In addition to or instead of this, according to an example, chemically pulped natural fibre is divided into at least fibre fractions before calcium carbonate is precipitated in connection with at least one of said chemically pulped fibre fractions.

In an advantageous example, a gradient calender is used for calendering a printing paper product, to achieve a printing paper product with low density. Advantageously, the gradient calender is a temperature gradient calender and/or a moisture gradient calender.

The grammage of the printing paper product according to the invention, preferably so-called SC paper, is suitably in the range of 27 to 70 g/m$^2$, preferably in the range of 35 to 60 g/m$^2$.

Preferably, the printing paper product according to the invention is calendered and uncoated with a pigment, having a grammage of 27 to 70 g/m$^2$, preferably 35 to 60 g/m$^2$. Preferably, it contains at least mechanically pulped natural fibres and precipitated calcium carbonate as a filler. Advantageously, the filler content in said printing paper product is $$y \geq 0.897x - 12.5,$$

more advantageously $$y \geq 0.897x - 10,$$

in which y represents the filler content (wt-%) and x represents the grammage (g/m$^2$).

Advantageously, in the method according to the invention for manufacturing a printing paper product, natural fibres are introduced in a system comprising a paper machine. Furthermore, the method advantageously comprises admixing calcium hydroxide and carbon dioxide as a continuous partial flow into the paper manufacturing process comprising natural fibres, for precipitating calcium carbonate, preferably at least partly onto the surfaces of said natural fibres, and manufacturing a printing paper product by said paper machine, the product comprising at least said natural fibres as well as precipitated calcium carbonate as a filler in said printing paper product.

The manufacturing method and the product according to the method have several advantages. The uncoated printing paper product according to the invention can be manufactured in such a way that the density of, for example, a calendered final product of 52 g/m$^2$ remains lower than 1100 kg//m$^3$, preferably lower than 1050 kg/m$^3$. Because the density that is lower than conventionally, the rigidity of the printing paper product is typically improved. The filler content of a calendered printing paper product made by the method according to the invention may be more than 2 percentage units and even more than 4 percentage units greater compared with corresponding products of prior art. In addition or alternatively, the content of chemical pulp in said printing paper product may be considerably lower than conventionally, being even 0%.

DESCRIPTION OF THE DRAWINGS

In the following, the invention will be described in more detail with reference to the appended drawings, in which.

DETAILED DESCRIPTION OF THE INVENTION

Figure 1A:
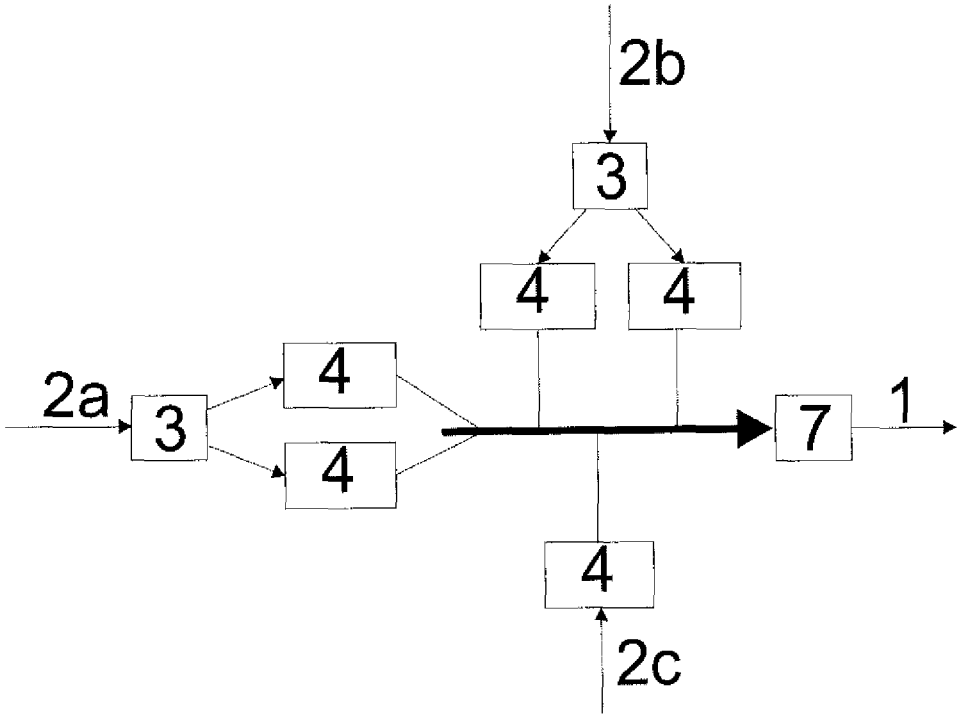
FIGS. 1*a-d* show reduced schematic views of elements in a system according to some embodiments of the invention for manufacturing a printing paper product.
Figure 1B:
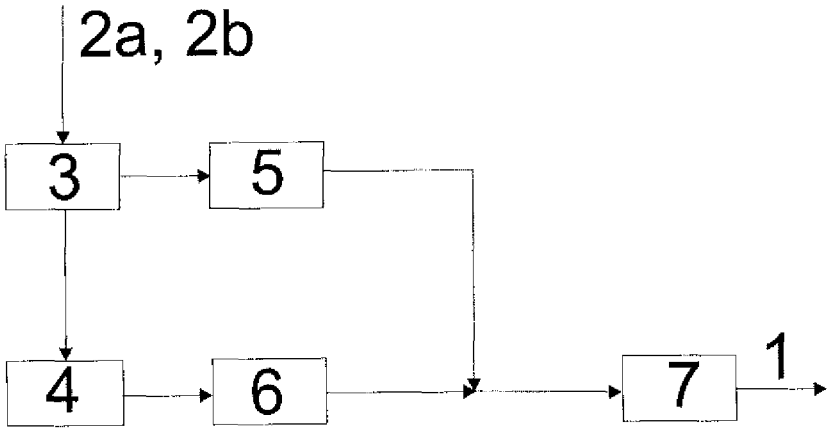
Figure 1C:
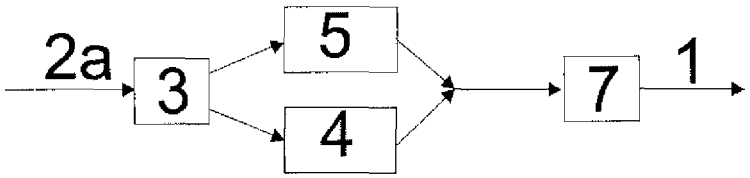
Figure 1D:
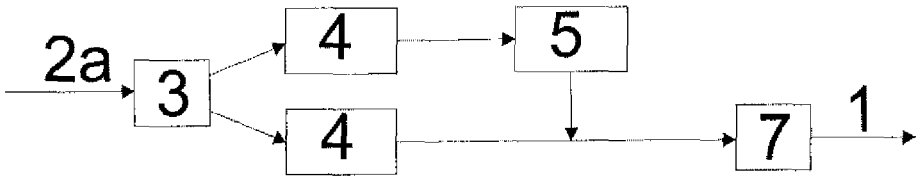

In this application, the term natural fibre is used, referring to various fibres of natural origin. The natural fibre may be, for example, mechanically pulped fibre, dissolving cellulose fibre, sulphite cellulose fibre, sulphate cellulose fibre, or viscose fibre. In one embodiment, the natural fibre is selected from the group of wood-based fibres, fibres of plant origin, and their derivatives and mixtures. In one example, the natural fibre is selected from the fibres of wood, sisal, jute, hemp, flax, straw, and other annual plants, as well as mixtures of these. Preferably, the printing paper product according to the invention comprises wood fibres as the main raw material. The content of natural fibres in the finished (dry) printing paper product is advantageously not higher than 80 wt-%, more advantageously not higher than 70 wt-%, but preferably at least 50 wt-%.

In this application, the measured values for density, gloss, grammage, porosity, and smoothness refer to measurements according to the following standards:

for density: ISO 534,
for gloss: ISO 8254-1,
for grammage: ISO 536,
for porosity: ISO 5636-3, and
for smoothness: ISO 8791-4.

The printing paper product according to the invention always comprises mechanically pulped natural fibres. In this application, the mechanically pulped natural fibres are also called mechanical pulp. According to an advantageous example, the main raw material of mechanically pulped natural fibre is softwood, such as for example pine, Southern pine, and/or spruce. Advantageously, the main raw material of natural fibre is spruce. The mechanically pulped natural fibre is advantageously selected from thermomechanical pulp (TMP), chemithermomechanical pulp (CTMP), bleached chemithermomechanical pulp (BCTMP), pressurized ground wood (PGW), ground wood (GW), refiner mechanical pulp (RMP), recovered fibre (RCF), or mixtures of these. According to an advantageous example, said natural fibre has been subjected to chemical treatment to reduce the lignin content. According to an advantageous example, the invention utilizes bleached TMP which has been fractionated into at least two separate fibre fractions before precipitating calcium carbonate onto the surface of at least one fibre fraction.

The printing paper product according to the invention may comprise chemically pulped natural fibres, which are also called chemical pulp in this application. In an example, the raw material for a chemically pulped fibre fraction has been pine, spruce, birch, eucalyptus, and/or acacia.

The process according to the invention makes it possible to manufacture a printing paper product in such a way that the specific energy consumption (SEC) may be lower than in the solutions of prior art. According to an example, mechanically pulped natural fibre is produced in a TMP process, in which the consumption of specific energy used for refining has been lower than 2.5 MWh per ton of finished printing paper, most advantageously lower than 2.2 MWh per ton of finished printing paper.

In the solution according to the invention, the filler in the printing paper product comprises precipitated calcium carbonate. In continuous precipitation of calcium carbonate, calcium carbonate is precipitated in connection with a selected material in such a way that calcium carbonate adheres at least partly to the surfaces of said material. The solution according to the invention always comprises a step in which calcium carbonate is precipitated from calcium hydroxide $Ca(OH)_2$ in a continuous process (continuous precipitated calcium carbonate, CPCC), in such a way that calcium carbonate is precipitated onto the surfaces of mechanically pulped natural fibres. The reactive mineral material used for said filler is calcium hydroxide, advantageously an aqueous solution of calcium hydroxide, which is also called milk of lime (MOL). The precipitating chemical used for said filler is advantageously carbon dioxide, preferably pure or almost pure carbon dioxide (degree of purity preferably 85 to 100%).

In this application, reference is made to FIGS. 1 to 5, in which the following reference numerals are used:

1 printing paper product according to the invention,
2 raw material(s) for the printing paper product,
2*a* mechanically pulped fibre,
2*b* chemically pulped fibre/pulp,
2*c* inorganic pigment,
3 separator for separation or fractionation,
4 means for precipitating calcium carbonate,
5 means for chemical processing of natural fibres,
6 container, and
7 papermaking machine.

In the solution according to the invention, mechanical pulp and/or chemical pulp is divided into at least two different fractions. Thus, according to an advantageously example, one or more physical properties in said at least two different pulp fractions differ substantially from each other. Said different physical property in the fractions may comprise one or more of the following:

fibre length distribution,
specific surface area of fibres,
flexibility of fibres, and
degree of fibrillation of fibres.

According to an advantageous example, the division of the pulp into at least two different fractions is made on the basis of the size and/or shape of particles. The continuous precipitation 4 of calcium carbonate according to the invention is performed for one or more fibre fractions.

According to an advantageous example, mechanically pulped natural fibres are divided into at least two different fractions before calcium carbonate is precipitated in connection with at least one fraction. In addition or instead, chemically pulped natural fibres can be divided into at least two different fractions before calcium carbonate is precipitated in connection with at least one fraction. According to an advantageous example, a product made by the example does not contain any chemically pulped natural fibres, in which case the precipitation of calcium carbonate is performed for at least one mechanically pulped natural fibre fraction.

The classification 3 or fractionation of mechanical pulp 2*a* and/or chemical pulp 2*b* into at least two fibre fractions can be already performed for the raw material introduced into the system. Thus, said classification may have been performed, for example, in connection with the process of pulping the natural fibres. In an example, the fractionation of mechanical pulp 2*a* into at least two fibre fractions has been a part of the production of said mechanical pulp, wherein accepted fractions formed via classification in the production of mechanical pulp 2*a*, such as, for example, refiner mechanical pulp or groundwood pulp, are utilized in the form of at least two different fractions. In this case, a separate classifying step 3 is not necessarily needed. In addition to or instead of what has been said above, the classification 3 may be part of the process according to the invention.

In classification according to the invention, both the reject from the classifier 3 and the accept from the classifier 3 of at least classifying step are preferably utilized in the actual paper manufacture. If the system comprises several classifying steps, at least the last classification preceding the precipitation of calcium carbonate is preferably performed for such pulp that can be utilized in whole or substantially in whole for manufacturing a printing paper product 1.

The mechanical pulp 2*a* used as the raw material may be pulp bleached already before it is supplied into the process according to the invention, and/or it can be bleached in the process according to the invention. According to an example, the bleaching of the mechanical pulp 2*a* is done in a process in which lignin causing blackening of the fibre raw material is diluted with chemicals. Such a bleaching process may be, for example, peroxide bleaching. According to an advantageous example, mechanical pulp is divided into at least two fractions or fibre fractions before a separate bleaching step (not shown in the figures), after which one or more fibre fractions are led into said bleaching process. According to another example, said bleaching process is carried out on homogeneous mechanical pulp. Thus, the classification into at least two fibre fractions is suitably performed after the last bleaching step. The bleaching of mechanically pulped natural fibres is suitably performed before the step of precipitating calcium carbonate.

According to an advantageous example, the dry content of mechanical pulp 2*a* which has been bleached at least partly is increased after the bleaching step. According to an example, the dry content of one or more natural fibre fractions is increased to a fibre consistency of at least 8% and preferably higher than 20%. The dilution of each pulp fraction to a predetermined consistency after the precipitation is preferably performed by using the circulation waters of the paper machine as the dilution water.

According to an advantageous example, the precipitation of calcium carbonate into at least one mechanically pulped fraction and/or chemically pulped fraction is performed by first adding carbon dioxide to said at least one fibre fraction that contains pulped natural fibres, and then adding calcium hydroxide in an aqueous solution. The carbon dioxide addition can be made, for example, by injection.

FIGS. 1*a* to 1*d* show some examples of some steps of the system according to the invention in reduced schematic charts. Naturally, the system according to the invention may also comprise other partial steps of printing paper manufacture than those shown in FIG. 1.

A paper machine 7 comprises at least a forming section, a press section, and a drying section. The short circulation of the paper machine typically comprises, among other things, a wire pit, deaeration means, as well as means for removing impurities.

Mechanically pulped natural fibre 2*a*, i.e. mechanical pulp, and/or chemically pulped natural fibre 2*b*, i.e. chemical pulp, can be classified into at least two different fractions by a classifier 3, after which calcium carbonate can be precipitated 4 in one or more of said fractions before the fractions are led to the paper machine 7. For the sake of clarity, FIG. 1 show the division of natural fibre raw materials 2*a*, 2*b* into only two fractions or fibre fractions, although there may also be more fibre fractions. Furthermore, it is possible that no chemical pulp 2*b* is used at all. It should also be noted that the partial fractions can also be returned to the system in a different order than that shown in the figures. The partial fractions can be returned to substantially the same process step, or they can be returned to different steps in the process.

According to an example, the printing paper product comprises, in addition to precipitated calcium carbonate, at least one inorganic pigment 2*c* other than said precipitated calcium carbonate. Thus, calcium carbonate may have been precipitated to said inorganic pigment 2*c* by precipitation means 4.

According to an advantageous example, lime of milk and carbon dioxide are supplied to an aqueous solution of the inorganic pigment 2*c*, for precipitating calcium carbonate onto the surfaces of said inorganic pigment. Thus, a new hybrid pigment is formed, in which said inorganic pigment is coated at least partly with precipitated calcium carbonate. According to an advantageous example, said inorganic pigment is selected from titanium dioxide, kaolin, talc, milled calcium carbonate, chalk, feldspar, mica, and waste pigment flow from a deinking plant.

The fractioning of the mechanical pulp 2*a* and/or the chemical pulp 2*b* with the classifier 3 into at least two fractions before the precipitation of calcium carbonate can be performed with a classifier of prior art. The classifier 3 may be, for example, a screen or a cyclone. According to an advantageous example, the classifier 3 is a pressure screen. In an example, at least one fractionating classifier is placed in connection with the short circulation of the paper machine. In another example, at least one fractionating classifier is placed in the area between the so-called machine chest and the so-called mixing tank in papermaking. In a third example, at least one fractionating classifier is placed upstream of said so-called mixing tank. The different fractions produced in connection with fractionating can be processed in different ways, and after possible processing they can be returned as raw material for papermaking to different papermaking process steps.

According to an advantageous example, at least one mechanically pulped and/or chemically pulped fraction is treated with a chemical, such as starch, after the fractionation in the process according to the invention. According to an advantageous example, said chemical is selected from starch, cationic starch, xylan, galactoglucomannan, calcium hydroxide, peracetic acid, or other reacting chemicals, as well as other polymers with a long-chained and/or branched molecular structure, as well as various modifications of the above mentioned chemicals. According to an example, at least one mechanically and/or chemically pulped fraction is treated with a cationic chemical after the fractionation.

In an example, said chemical treatment 5 as well as said precipitation 4 of calcium carbonate are performed for at least one and the same fibre fraction. Thus, in an advantageous example, the adherence of the filler formed onto the surfaces of the natural fibre raw material in the calcium carbonate precipitation reaction 4 (CPCC) is intensified by a chemical treatment by dosing one or more chemicals into one or more fibre fractions in which calcium carbonate is precipitated (not shown in the figures). According to an advantageous example, said chemical to enhance the adherence is selected from starch, cationic starch, xylan, galactoglucomannan, calcium hydroxide, peracetic acid, or other reacting chemicals, as well as other polymers with a long-chained and/or branched molecular structure, as well as various modifications of the above mentioned chemicals.

According to another example, said chemical treatment 5 and the precipitation 4 of calcium carbonate are performed for different fractions. Thus, in an example, the chemically treated fraction is returned to a different step in the process compared with the fraction in which calcium carbonate has been precipitated. Thus, the retention time of said chemically treated fraction in the process may be substantially different from the retention time of at least one other fraction.

In an example, the chemical treatment 5 is implemented for a short fibre fraction. Thus, according to an advantageous example, at least one chemically treated fibre fraction is led, after said chemical treatment 5, to the short circulation of the paper machine. In an example, the chemically treated fraction is introduced into the so-called headbox feed pump of the paper machine. In an example, the chemically treated fraction is led to the so-called mixing tank.

When the reaction of precipitating calcium carbonate is allocated to one or more partial fractions of the fibre raw material, it is possible to reduce the content of so-called interfering substances (such as resin, dissolved and colloidal detrimental elements), which have been developed in said fraction in connection with pulping and/or bleaching, in the aqueous phase. This reduction may be, for example, at least 10 percentage units or at least 20 percentage units compared with a situation without the method according to the invention for producing a filler. The contents of interfering substances can be detected, for example, by measuring them on component level, for example, as contents in ppm. According to an advantageous example, the required quantity of retention material after the precipitation reaction is about 30% lower compared with a situation without the method of manufacture according to the invention.

In an example, the printing paper product 1 according to the invention is formed by mixing all the different partial fractions to a pulp suspension upstream of the paper machine 7 and by leading this pulp suspension to the paper machine, for forming a paper product. According to another advantageous example, the printing paper product 1 according to the invention is formed by leading the above described partial fractions, either as such or partly mixed with each other, to the paper machine 7, to form a printing paper product with a layered structure. Thus, the desired partial fractions can be led to the middle layer of the printing paper product, and the desired partial fractions to the surface layers of said paper, for example by means of a multilayer headbox. In this way it is possible to optimize the structure of the paper. According to an advantageous example, the fractions which improve the bulk and/or the strength in the z-direction are led to the middle layer of the paper, and the fractions which improve printability are led to the surface layers.

According to an advantageous example, the infiltration of the web formed of the pulp suspension supplied in the form of partial fractions or a single fraction to the paper machine is performed at least partly by means of a planar band and/or surfaces provided with holes or perforations, and dewatering elements in the forming section.

In an example, the method according to the invention comprises one or more of the following steps in a predetermined order.

- Introducing mechanically pulped natural fibres 2*a* into the system.
- Introducing chemically pulped natural fibres 2*b* into the system.
- Introducing inorganic pigment 2*c* into the system.
- Dividing mechanically pulped natural fibres 2*a* into at least two fibre fractions by a classifier 3.
- Bleaching at least one fraction of said mechanically pulped fibres 2*a*.
- Dividing chemically pulped natural fibres 2*b* into at least two fibre fractions.
- Admixing lime of milk and carbon dioxide into at least one fraction of said mechanically pulped fibres 2*a*, for precipitating calcium carbonate onto the surfaces of said natural fibres.
- Admixing lime of milk and carbon dioxide into at least one fraction of said chemically pulped fibres 2*b*, for precipitating calcium carbonate onto the surfaces of said natural fibres.
- Admixing lime of milk and carbon dioxide to the inorganic pigment 2*c*, for precipitating calcium carbonate onto the surfaces of the inorganic pigment 2*c*.
- Admixing a chemical into at least one of the fibre fractions formed.
- Supplying the above-mentioned raw materials either as a uniform pulp suspension or as separate material flows to a paper machine 7.
- Forming a printing paper product in the paper machine 7.

Calendering the printing paper product 1 to be manufactured with a gradient calender.

In the solution according to the present invention, the final product formed is an uncoated printing paper product, such as, for example, magazine paper or newsprint, most advantageously supercalendered (SC) paper, which contains precipitated calcium carbonate as a filler and mechanically pulped natural fibres as the main fibre raw material. In addition, the printing paper product may contain chemically pulped natural fibres. At least part of said mechanically pulped natural fibres and/or chemically pulped natural fibres are at least partly coated with precipitated calcium carbonate. In addition to the precipitated calcium carbonate, the printing paper product may contain at least one other filler. In an example, calcium carbonate is precipitated in at least one other filler.

By the method according to the present invention, it is possible to manufacture SC paper in such a way that the product requires gentler calendering than conventionally but still obtains the printing properties required for SC paper. In an example, the SC paper according to the invention is gradient calendered in such a way that the density of the product after the calendering is lower than 1100 kg/m$^3$, more preferably less than 1050 kg/m$^3$, and most preferably lower than 1000 kg/m$^3$. Thanks to the gentler calendering than conventionally, the stiffness and optical properties of the SC paper may be improved. Furthermore, the tear strength of the paper may remain on a higher level, thanks to the lower linear load caused by the gentler calendering. The higher tear strength level may contribute to enable a reduction in the pulp content in the raw materials of the paper without causing problems in, for example, the runnability of the final product in the printing works, and/or an increase in the filler content.

According to an advantageous example, the calendering of the printing paper product, advantageously SC paper, is performed with a so-called gradient calender. During the gradient calendering, very small drops of water, or spray water, is applied onto the paper web. Thus, the paper web can be subjected by the calender rolls and/or steam boxes to a high temperature, for directing the surface forming effect of calendering primarily to the surface of the paper to be calendered. As a result, the density of the paper after the calendering can be brought to a lower level than normally.

In an example, the content of mechanical pulp in the natural fibres used in the printing paper product is thus at least 70 wt-%, at least 80 wt-% or at least 90 wt-%, and more advantageously 100 wt-%. According to an advantageous example, the mechanical pulp consists at least primarily of TMP.

Figure 3:
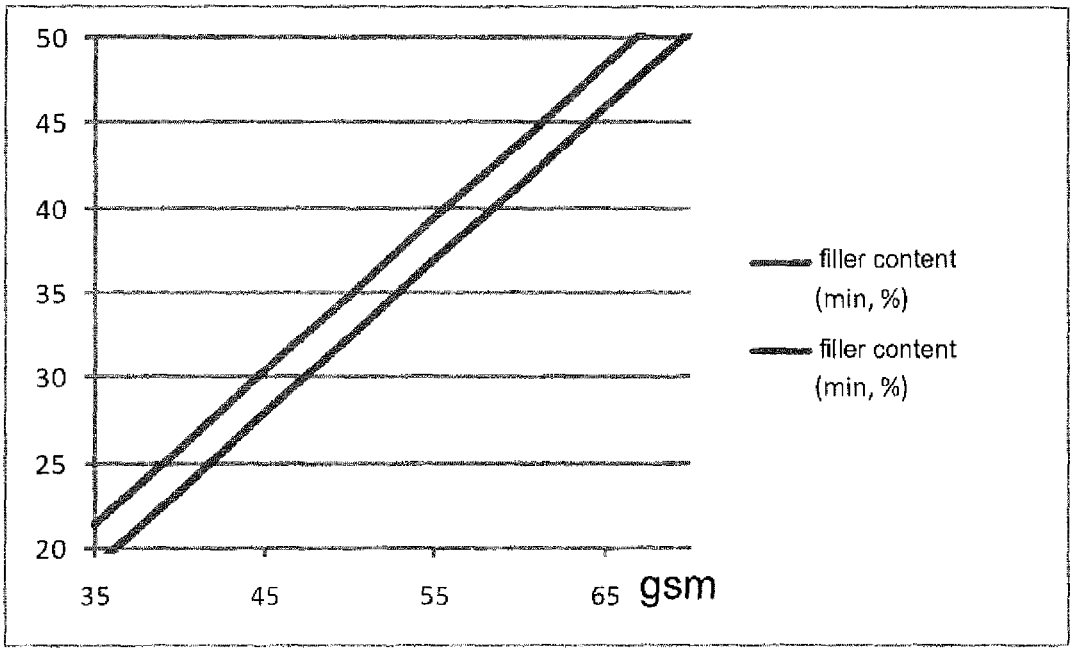

In an advantageous example, the SC paper according to the invention contains about 2 to 4 percentage units more fillers than SC paper of prior art. Suitably, the filler content of SC paper according to the invention follows the formula $$Y \geq 0.897x - 12.5,$$

preferably the formula:

$$Y \geq 0.897x - 10,$$

in which formulae Y represents the filler content and x represents the grammage. These straight lines according to the formulae are shown in FIG. 3. Increasing the filler content has an advantageous effect on both the manufacturing costs of SC paper and the optical properties of the paper.

Figure 4:
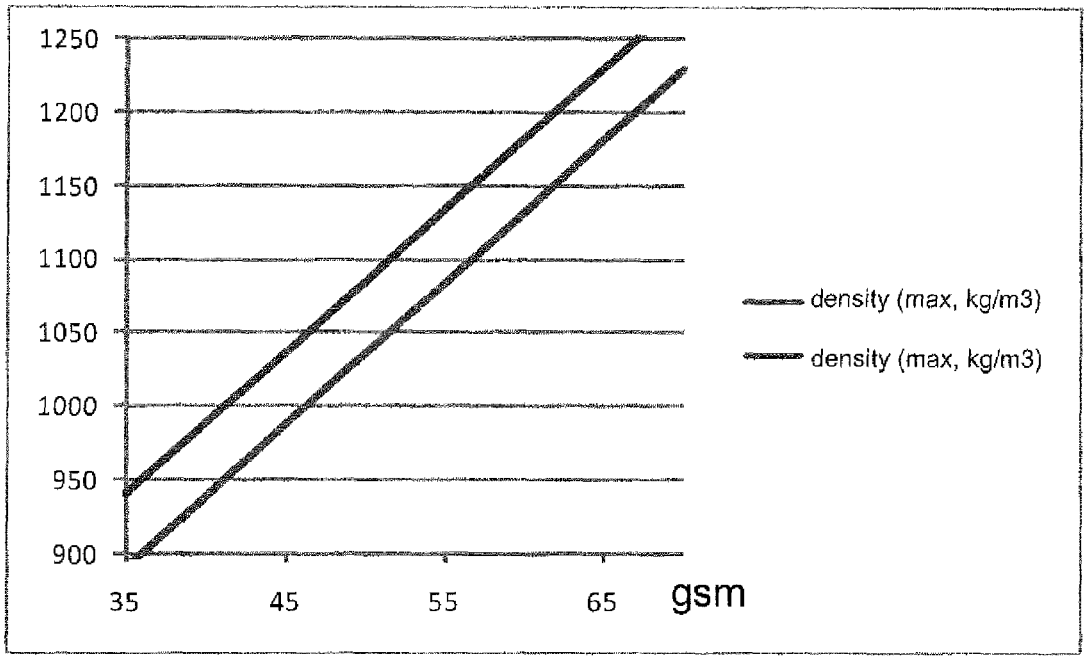

Suitably, the density of calendered SC paper according to the invention follows the formula:

$$Y \leq 9.7x + +600 \text{ kg/m}^3$$

preferably the formula:

$$Y \leq 9.7x + +550 \text{ kg/m}^3$$

in which formulae Y represents the density of calendered paper and x represents the grammage. These straight lines according to the formulae are shown in FIG. 4.

The printing paper product according to the invention has at least some or all of the properties listed below:

The printing paper product is SC paper.

The printing paper product is uncoated.

The printing paper product is calendered.

The grammage of the printing paper product is suitably 27 to 70 g/m$^2$, preferably in the range from 35 to 60 g/m$^2$.

The density of the calendered printing paper product follows the following formula:

$Y \leq 9.7x + 600$ kg/m$^3$, in which Y represents the density and x represents the grammage, wherein the density of a printing paper product of, for example, 52 g/m$^2$ is suitably lower than 1100 kg/m$^3$, and/or the density of the calendered printing paper product may follow the following formula:

$Y \leq 9.7x + 550$ kg/m$^3$, in which Y represents the density and x represents the grammage, wherein the density of a printing paper product of, for example, 52 g/m$^2$ is suitably lower than 1050 kg/m$^3$.

The gloss of the calendered printing paper product follows the following formula, defined by Hunter Gloss 75° measurement:

The gloss of the calendered printing paper product is, for example for a paper of 52 g/m$^2$, at the level of 49±4, and for example for a paper of 41 g/m$^2$, at the level of 41±4, defined by Hunter Gloss 75° measurement.

The porosity (Bendtsen) of the calendered printing paper product is, for example for a paper of 52 g/m$^2$, at the level of 19 to 27 ml/min, and for example for a paper of 41 g/m$^2$, at the level of 32 to 40 ml/min.

The smoothness (PPS10) of the calendered printing paper product is, for example for a paper of 52 g/m$^2$, at the level of 1.0 to 1.2 μm, and for example for a paper of 41 g/m$^2$, at the level of 1.18 to 1.36 μm.

The strength of the calendered printing paper is at a level sufficient for runnability at a printing works.

The following examples present some properties of SC paper manufactured by the method according to the invention.

Example 1

FIGS. 2 to 5 show an example of the filler content in relation to the grammage of the printing paper product according to the invention.

Figure 2:
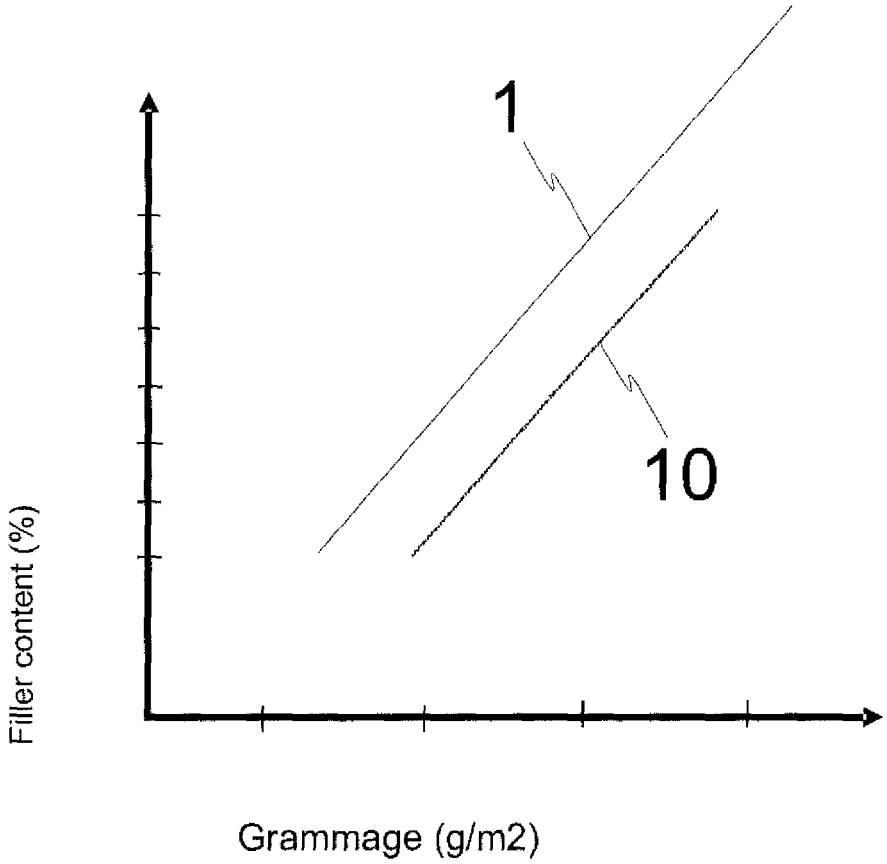
FIGS. 2 to 5 show some examples of the properties of a printing paper product according to the invention.

FIG. 2 shows a comparison between two SC papers, of which one (number 1) has been made by the method of the invention and the other (number 10) by a method of prior art. Both products have corresponding strength properties (tear strength, tensile strength, z-strength). The density of the paper made by the method of the invention is lower than 1100 kg/m$^3$, whereas the density of the paper of prior art is higher than 1100 kg/m$^3$. With each grammage, the filler content of the printing paper product according to the invention is about 4 percentage units higher than for the paper of prior art.

FIG. 3 shows an advantageous minimum filler content and the most advantageous minimum filler content for the product according to the invention, in relation to the grammage.

FIG. 4 shows an advantageous maximum density and the most advantageous maximum density of the calendered printing paper product according to the invention, in relation to the grammage.

Figure 5:
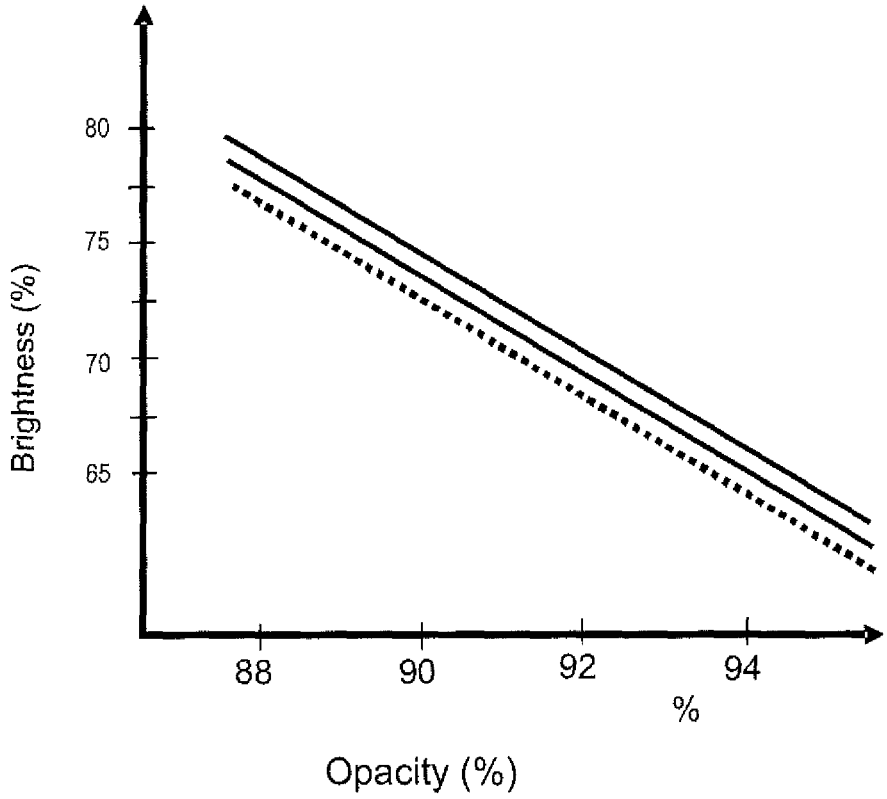

FIG. 5 shows the relation of brightness to opacity for SC paper according to the invention, with a grammage of 52 g/m$^3$. The uppermost line in the figure represents a situation in which the filler content of the product according to the invention is 4% higher than in products of prior art and the product is calendered by gradient calendering. The middle line represents a situation in which the filler content of the product according to the invention has been raised by 2% with respect to products of prior art, and the product has been calendered by a conventional 12-roll supercalender. The lowermost line represents the properties of SS paper of prior art.

Thanks to the present invention, the method according to the invention can be used to manufacture SC paper in a cost efficient way so that the product has a considerably high filler content and a low density, that is, a high bulk. In spite of this, the SC paper according to the invention can still obtain the printing and strength properties that meet the requirements.

The optical properties of SC paper according to the invention, having a low density and a high filler content, can be considerably improved. For example, opacity and brightness can improve by 1 to 3 percentage units compared with corresponding values for known products having a high density (>1100 kg/m$^3$) and a conventional filler content (20 to 33% in the grammage range of 35 to 60 g/m$^2$).

The method according to the invention has several advantages. The novel method according to the invention allows a higher filler content and/or a lower content of chemically pulped natural fibre (pulp) compared with paper grades manufactured by techniques of prior art. The method according to the invention also makes it possible to reduce the specific energy consumption compared with a similar product manufactured by techniques of prior art. In other words, by the solution according to the invention it is possible to manufacture an uncoated calendered printing paper product whose concurrent properties may include a higher filler content than at present, a lower density level than at present, and still substantially equally good printing surface properties (smoothness, opacity, brightness).

It should be noted that the invention is not limited solely to the examples presented in FIGS. 1 to 5 and in the above description, but the invention is characterized in what will be presented in the following claims.

The invention claimed is:

1. A printing paper product which is calendered and uncoated with a pigment, having a grammage of 27 to 70 g/m$^2$, and containing at least mechanically pulped natural fibres, and precipitated calcium carbonate as a filler, wherein the filler content of said printing paper product is $$y \geq 0.897x - 12.5,$$

in which y represents the filler content (wt-%) and x represents the grammage (g/m$^2$).

2. The printing paper product according to claim 1, wherein the density of said printing paper product meets the following formula:

$$y \leq 9.7x + +600 \text{ kg/m}^3,$$

in which y is the density of the paper and x is the grammage of the paper.

3. The printing paper product according claim 1, wherein the printing paper product has a structure comprising at least two layers, the layers comprising different natural fibre fractions.

4. The printing paper product according to claim 1, wherein said printing paper product comprises a hybrid pigment containing precipitated calcium carbonate as one raw material and inorganic pigment as another raw material, the inorganic pigment being selected from titanium dioxide, kaolin, talc, milled calcium carbonate, chalk, feldspar, mica, and waste pigment flow from a deinking plant.

5. A method for manufacturing a printing paper product, in which natural fibres are introduced in a system which comprises a paper machine, wherein the method comprises:

admixing calcium hydroxide and carbon dioxide as a continuous partial flow into the paper manufacturing process comprising natural fibres, for precipitating calcium carbonate, and manufacturing a printing paper product by said paper machine, the product comprising at least said natural fibres as well as precipitated calcium carbonate as a filler in said printing paper product, wherein the filler content of said printing paper product is $$y \geq 0.897x - 12.5,$$

in which v represent the filler content (wt-%) and x represent a grammage of said printing paper product in the range of 27 to 70 g/m$^2$.

6. The method according to claim 5, wherein said natural fibres comprise mechanically pulped natural fibres, and that the content of said mechanically pulped natural fibres of the natural fibres used in the printing paper product is preferably at least 70 wt-%, and that the method comprises classifying said mechanically pulped natural fibres into at least two different fibre fractions before adding calcium hydroxide into at least one of said mechanically pulped fibre fractions.

7. The method according to claim 5, wherein said natural fibres comprise mechanically pulped natural fibres and chemically pulped natural fibres, and that the method comprises classifying said chemically pulped natural fibres into at least two fibre fractions, precipitating calcium carbonate in at least one chemically pulped natural fibre fraction, and manufacturing a printing paper product comprising chemically pulped natural fibres, with calcium carbonate precipitated on their surfaces, and mechanically pulped natural fibres.

8. The method according to claim 5, wherein the method comprises introducing inorganic pigment into the system, admixing calcium hydroxide and carbon dioxide to said inorganic pigment, for precipitating calcium carbonate in said inorganic pigment, and manufacturing a printing paper product comprising said inorganic pigment with precipitated calcium carbonate.

9. The method according to claim 5, wherein the method comprises calendering the printing paper product to be manufactured with a gradient calender.

10. The method according to claim 5, wherein the method comprises admixing a chemical to at least one fibre fraction formed, the chemical being selected from: starch, cationic starch, xylan, galactoglucomannan, calcium hydroxide, peracetic acid, or other reacting chemicals, as well as other polymers with a long-chained and/or branched molecular structure, as well as various modifications of the above mentioned chemicals.

11. The method according to claim 10, wherein the addition of said chemical is performed for a different fraction than the precipitation of calcium carbonate.

12. The method according to claim 10, wherein the addition of said chemical is performed for the same fraction than the precipitation of calcium carbonate.

13. The method according to claim 5, wherein said natural fibres are supplied in the form of at least two separate fibre flows to the paper machine for manufacturing a printing paper product having a layered structure.

14. A system for manufacturing a printing paper product, the system comprising a paper machine, wherein the system comprises means for adding calcium hydroxide and carbon dioxide and for precipitating calcium carbonate onto the surfaces of the natural fibres, and means for supplying said natural fibres and precipitated calcium carbonate to the paper machine for manufacturing a printing paper product having the precipitated calcium carbonate as a filler, wherein the filler content of said printing paper product is $$y \geq 0.897x - 12.5,$$

in which v represent the filler content (wt-%) and x represent a grammage of said printing paper product in the range of 27 to 70 g/m$^2$.

15. The system according to claim 14, wherein the system comprises at least one classifier for dividing mechanically pulped natural fibres and/or chemically pulped natural fibres into at least two natural fibre fractions before the precipitation of calcium carbonate in at least one of said natural fibre fractions.

16. The system according to claim 14, wherein the system comprises means for adding an inorganic pigment into the system, and means for precipitating calcium carbonate in said inorganic pigment.

17. The system according to claim 14, wherein the system comprises a gradient calender for calendering the printing paper product to be manufactured.

18. The system according to claim 14, wherein the system comprises means for adding a chemical into at least one natural fibre fraction.

19. The system according to claim 14, wherein the system comprises means for introducing natural fibres in the form of at least two separate fibre flows into the paper machine, for manufacturing a printing paper product having a layered structure.

20. Uncoated printing paper product that is made by a method according to claim 5.

* * * * *